US011005218B2

(12) United States Patent
Trout et al.

(10) Patent No.: US 11,005,218 B2
(45) **Date of Patent: *May 11, 2021**

(54) SHIELDING STRUCTURE FOR AN ELECTRICAL CONNECTOR

(71) Applicant: TE Connectivity Services GmbH, Schaffhausen (CH)

(72) Inventors: David Allison Trout, Lancaster, PA (US); Douglas Edward Shirk, Elizabethtown, PA (US); Justin Dennis Pickel, Hummelstown, PA (US); Sean Patrick McCarthy, Palmyra, PA (US)

(73) Assignee: TE Connectivity Services GmbH, Schaffhausen (CH)

( * ) Notice: Subject to any disclaimer, the term of this patent is extended or adjusted under 35 U.S.C. 154(b) by 0 days.

This patent is subject to a terminal disclaimer.

(21) Appl. No.: 16/834,307

(22) Filed: Mar. 30, 2020

(65) Prior Publication Data

US 2020/0227866 A1 Jul. 16, 2020

Related U.S. Application Data

(63) Continuation of application No. 16/133,847, filed on Sep. 18, 2018, now Pat. No. 10,756,492.

(51) Int. Cl.

| | |
|---|---|
| ***H01R 13/648*** | (2006.01) |
| ***H01R 13/6587*** | (2011.01) |
| ***H01R 13/6594*** | (2011.01) |
| ***H01R 13/6471*** | (2011.01) |
| ***H01R 13/514*** | (2006.01) |
| ***H01R 12/72*** | (2011.01) |

(52) U.S. Cl.
CPC ..... *H01R 13/6587* (2013.01); *H01R 12/727* (2013.01); *H01R 13/514* (2013.01); *H01R 13/6471* (2013.01); *H01R 13/6594* (2013.01)

(58) Field of Classification Search
CPC ..... H01R 13/6587
USPC ..... 439/607.07, 607.08, 607.11, 607.09
See application file for complete search history.

(56) References Cited

U.S. PATENT DOCUMENTS

| | | | | |
|---|---|---|---|---|
| 8,382,522 | B2 | 2/2013 | Glover et al. | |
| 8,419,472 | B1 | 4/2013 | Swanger et al. | |
| 8,430,691 | B2 * | 4/2013 | Davis | H01R 13/6585 439/607.09 |
| 8,444,434 | B2 | 5/2013 | Davis et al. | |
| 8,500,487 | B2 | 8/2013 | Morgan et al. | |
| 8,662,924 | B2 | 3/2014 | Davis et al. | |
| 8,888,530 | B2 | 11/2014 | Trout et al. | |
| 8,894,442 | B2 | 11/2014 | McClellan et al. | |
| 8,992,252 | B2 | 3/2015 | McClellan et al. | |
| 9,136,634 | B2 * | 9/2015 | De Geest | H01R 12/724 |

(Continued)

*Primary Examiner* — Phuong K Dinh

(57) ABSTRACT

An electrical connector includes a front housing having a front and a rear. The front housing is configured to hold signal contacts and has a cavity at the rear. The front is configured to be mated with the mating connector. A conductive insert is received in the cavity. The conductive insert includes end walls and cross walls extending between the end walls. The conductive insert includes channels between the cross walls configured to receive ground shields used to provide electrical shielding for the signal contacts. The cross walls are configured to be electrically coupled to the corresponding ground shields. The conductive insert is configured to electrically couple each of the ground shields.

20 Claims, 13 Drawing Sheets

(56) References Cited

U.S. PATENT DOCUMENTS

| | | | |
|---|---|---|---|
| 9,281,579 | B2 | 3/2016 | Davis et al. |
| 9,608,382 | B2 | 3/2017 | McClellan et al. |
| 9,666,991 | B2 | 5/2017 | Davis |
| 10,096,924 | B2 | 10/2018 | Trout et al. |
| 10,186,811 | B1 | 1/2019 | Trout et al. |
| 2013/0273781 | A1 | 10/2013 | Buck et al. |
| 2014/0148054 | A1 | 5/2014 | Annis et al. |
| 2014/0194004 | A1 | 7/2014 | Pickel et al. |
| 2016/0072231 | A1 | 3/2016 | Sypolt et al. |
| 2019/0237911 | A1 | 8/2019 | Munoz et al. |

* cited by examiner

SHIELDING STRUCTURE FOR AN ELECTRICAL CONNECTOR

CROSS-REFERENCE TO RELATED APPLICATIONS

This application is a continuation of pending U.S. application Ser. No. 16/133,847, which was filed Sep. 18, 2018, and the entire disclosure of which is incorporated herein by reference.

BACKGROUND OF THE INVENTION

The subject matter herein relates generally to shielding structures for electrical connectors.

Some electrical systems utilize electrical connectors, such as header assemblies and receptacle assemblies, to interconnect two circuit boards, such as a motherboard and daughtercard. Some known electrical connectors include a front housing holding a plurality of contact modules arranged in a contact module stack. The electrical connectors provide electrical shielding for the signal conductors of the contact modules. For example, ground shields may be provided on one or both sides of each contact module. However, at high speeds, the electrical shielding of known electrical connectors may be insufficient. For example, shielding within the front housing, such as at the mating interface between the header and receptacle assemblies is difficult and inadequate in conventional electrical connectors.

A need remains for a shielding structure for electrical connectors proximate to the mating interface with the mating electrical connector.

BRIEF DESCRIPTION OF THE INVENTION

In an embodiment, an electrical connector includes a front housing having a front and a rear. The front housing is configured to hold signal contacts and has a cavity at the rear. The front is configured to be mated with the mating connector. A conductive insert is received in the cavity. The conductive insert includes end walls and cross walls extending between the end walls. The conductive insert includes channels between the cross walls configured to receive ground shields used to provide electrical shielding for the signal contacts. The cross walls are configured to be electrically coupled to the corresponding ground shields. The conductive insert is configured to electrically couple each of the ground shields.

In another embodiment, an electrical connector for mating with a mating connector having mating signal contacts and mating ground shields providing electrical shielding for the mating signal contacts is provided including a front housing having a front configured to be mated with the mating connector and a rear having a cavity. The electrical connector includes a conductive insert received in the cavity including end walls and cross walls extending between the end walls. The conductive insert includes channels between the cross walls configured to receive corresponding mating ground shields. The cross-walls include protrusions extending into the channels each having a mating interface configured to engage the corresponding mating ground shield. The conductive insert is configured to electrically couple each of the mating ground shields of the mating connector.

In another embodiment, an electrical connector for mating with a mating connector having mating signal contacts and mating ground shields providing electrical shielding for the mating signal contacts is provided including a front housing having a front configured to be mated with the mating connector and a rear having a cavity. The electrical connector includes a conductive insert received in the cavity including end walls and cross walls extending between the end walls. The conductive insert includes channels between the cross walls configured to receive corresponding mating ground shields. The cross-walls include protrusions extending into the channels each having a mating interface configured to engage the corresponding mating ground shield. The conductive insert is configured to electrically couple each of the mating ground shields of the mating connector. The electrical connector includes a contact module received in the cavity having a frame assembly including an array of signal contacts and a dielectric holder holding the array of signal contacts. Each signal contact has a mating end extending into the front housing for mating with the corresponding mating signal contact of the mating connector. The contact module has a ground shield coupled to the dielectric holder providing electrical shielding for the signal contacts having mating beams extending forward of the dielectric holder into the corresponding channel of the conductive insert. The mating beams extend into the front housing for mating with corresponding mating ground shields.

In a further embodiment, an electrical connector for mating with a mating connector having mating signal contacts and mating ground shields providing electrical shielding for the mating signal contacts is provided including a front housing having a front wall extending between a front surface and a rear surface. The front wall has a front wall thickness between the front surface and the rear surface of the front wall. The front housing has a cavity rearward of the rear surface of the front wall. The front surface is configured to be mated with the mating connector. The electrical connector includes a conductive insert received in the cavity rearward of and abutting the rear surface. The conductive insert includes end walls and cross walls extending between the end walls. The cross walls have front surfaces and rear surfaces. The front surfaces engage the rear surface of the front wall of the front housing. The cross walls have cross wall thicknesses between the front surfaces and the rear surfaces of the cross walls being approximately equal to the front wall thickness. The conductive insert includes channels between the cross walls configured to receive corresponding mating ground shields. The cross-walls include protrusions extending into the channels each having a mating interface configured to engage the corresponding mating ground shield. The conductive insert is configured to electrically couple each of the mating ground shields of the mating connector.

DETAILED DESCRIPTION OF THE INVENTION

Figure 1:
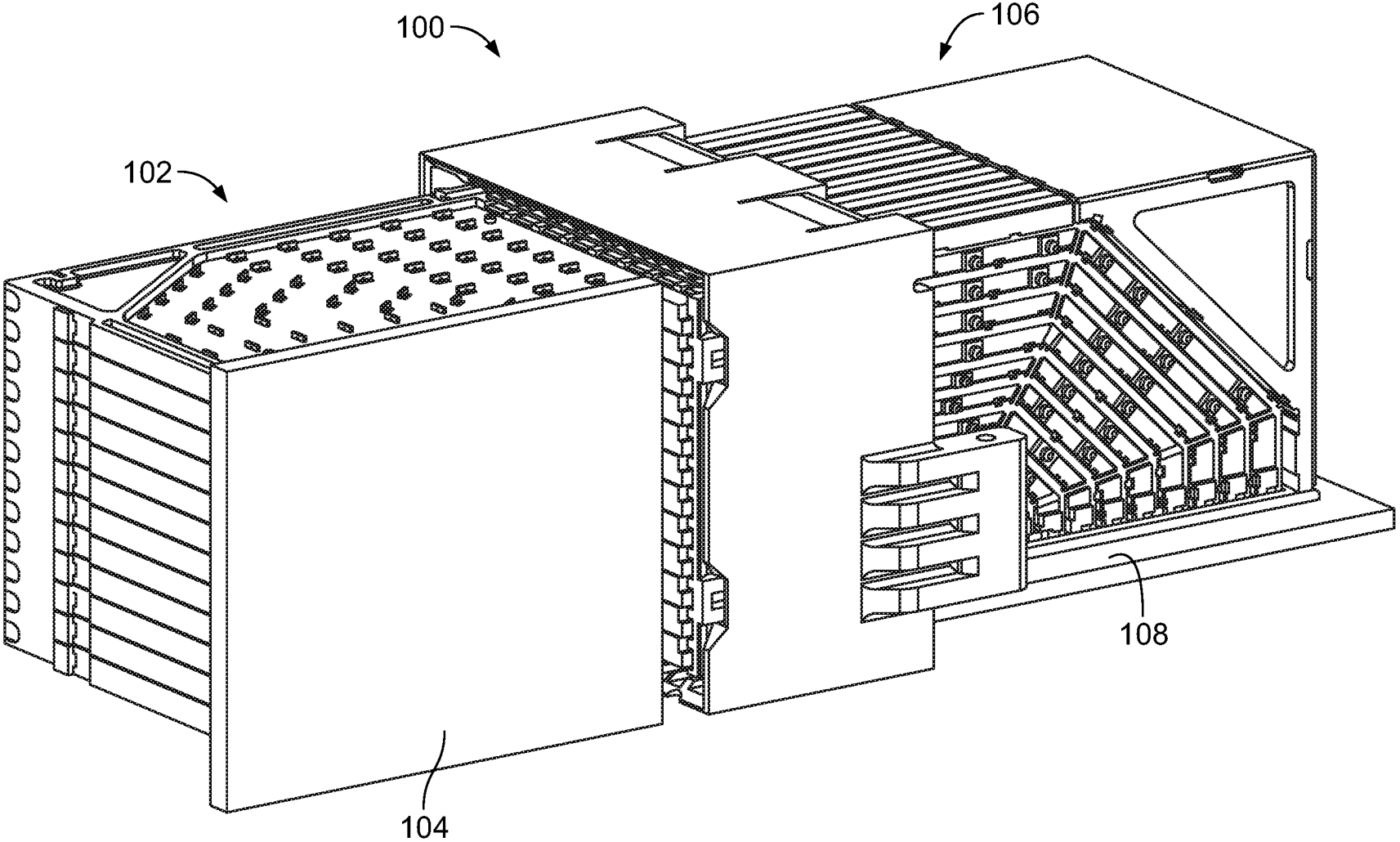
FIG. 1 is a front perspective view of an electrical connector system formed in accordance with an exemplary embodiment.

FIG. 1 is a front perspective view of an electrical connector system 100 formed in accordance with an exemplary embodiment. The connector system 100 includes an electrical connector 102 configured to be mounted to a circuit board 104 and a mating electrical connector 106, which may be mounted to a circuit board 108. The mating electrical connector 106 may be a header connector and may be referred to hereinafter as header connector 106. Various types of connector assemblies may be used in various embodiments, such as a right angle connector, a vertical connector or another type of connector.

In the illustrated embodiment, the electrical connector 102 is oriented orthogonal to the header connector 106. For example, the circuit board 104 is configured to be oriented perpendicular to the circuit board 108 (for example, vertically versus horizontally). Other orientations are possible in alternative embodiments.

The electrical connector 102 includes a shielding structure providing electrical shielding for signal transmission paths therethrough. The header connector 106 includes a shielding structure providing electrical shielding for signal transmission paths therethrough.

Figure 2:
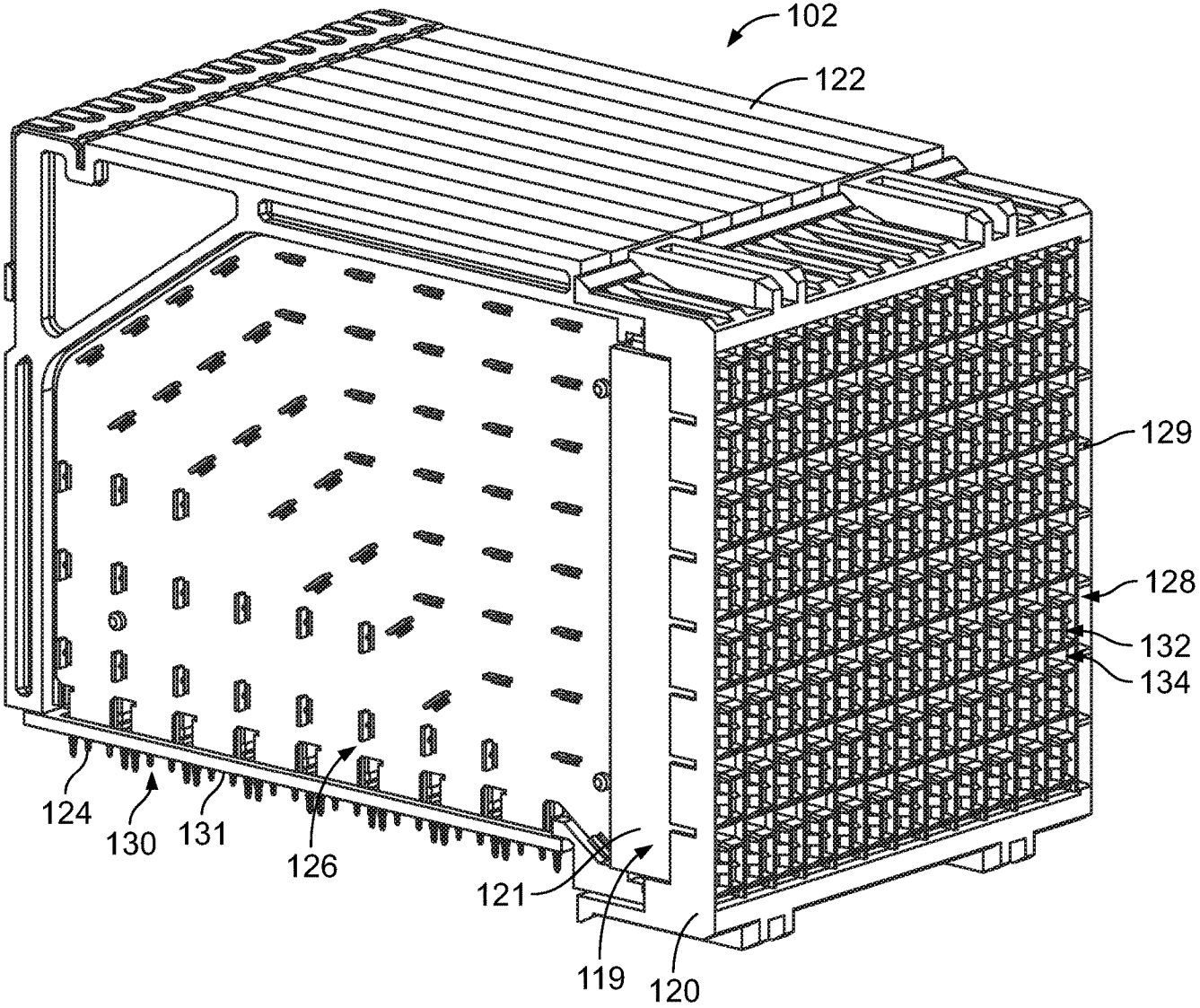
FIG. 2 is a front perspective view of an electrical connector of the electrical connector system in accordance with an exemplary embodiment.

FIG. 2 is a front perspective view of the electrical connector 102 in accordance with an exemplary embodiment. The electrical connector 102 includes a housing assembly 119 having a front housing 120 and a conductive insert 121 held in the front housing 120. The electrical connector 102 includes a plurality of contact modules 122 coupled to the housing assembly 119. The contact modules 122 are held in a stacked configuration generally parallel to one another. The contact modules 122 are loaded into the conductive insert 121 and the front housing 120 side-by-side in the stacked configuration as a unit or group. Any number of contact modules 122 may be provided in the electrical connector 102. The contact modules 122 each include a plurality of signal contacts 124 that define signal paths through the electrical connector 102. The signal contacts 124 are configured to be electrically connected to corresponding header signal contacts 112 of the header connector 106.

The electrical connector 102 includes a mating end 128, such as at a front 129 of the electrical connector 102, and a mounting end 130, such as at a bottom 131 of the electrical connector 102. In the illustrated embodiment, the mounting end 130 is oriented substantially perpendicular to the mating end 128. The mating and mounting ends 128, 130 may be at different locations other than the front 129 and bottom 131 in alternative embodiments, such as at a side, the rear or other locations. The signal contacts 124 extend through the electrical connector 102 from the mating end 128 to the mounting end 130 for mounting to the circuit board 104 (FIG. 1).

Figure 3:
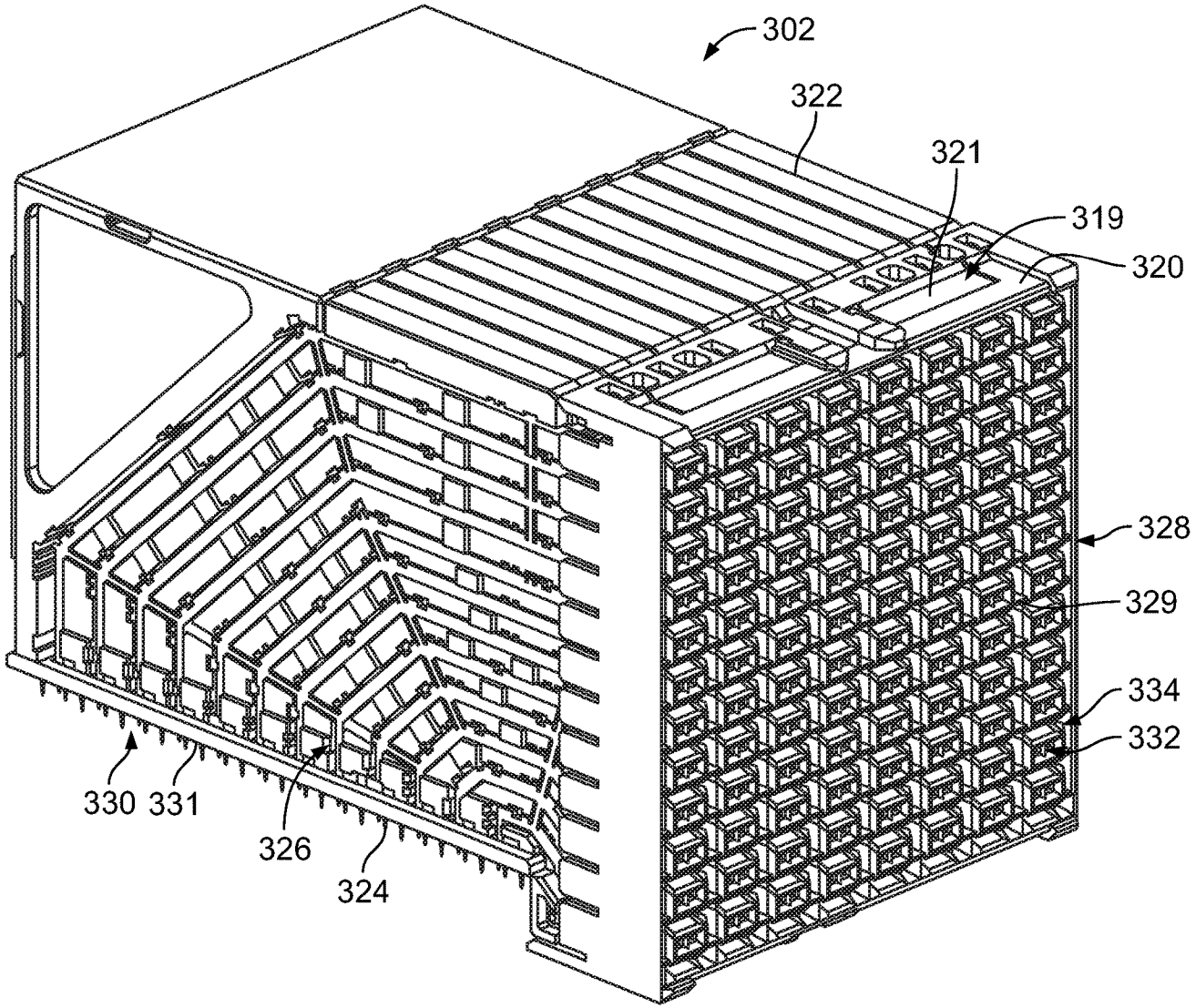
FIG. 3 is a front perspective view of an electrical connector in accordance with an exemplary embodiment.

The signal contacts 124 are received in the front housing 120 and held therein at the mating end 128 for electrical termination to the header connector 106. The conductive insert 121 provides electrical shielding for portions of the signal contacts 124, such as proximate to the mating interfaces of the signal contacts 124. The signal contacts 124 are arranged in a matrix of rows and columns. In the illustrated embodiment, at the mating end 128, the rows are oriented horizontally and the columns are oriented vertically. Other orientations are possible in alternative embodiments. Any number of signal contacts 124 may be provided in the rows and columns. Optionally, the signal contacts 124 may be arranged in pairs carrying differential signals; however other signal arrangements are possible in alternative embodiments, such as single-ended applications. The pairs of signal contacts 124 may be arranged in columns (pair-in-column signal contacts); however, the pairs of signal contacts may be arranged in rows (pair-in-row signal contacts, for example, as shown in FIG. 3) in alternative embodiments. In an exemplary embodiment, the signal contacts 124 within each pair are contained within the same contact module 122.

In an exemplary embodiment, each contact module 122 has a shield structure 126 for providing electrical shielding for the signal contacts 124. The conductive insert 121 forms part of the shield structure 126. The shield structure 126 is configured to be electrically connected to header ground shields 114 (shown in FIG. 4) of the header connector 106. The shield structure 126 may provide shielding from electromagnetic interference (EMI) and/or radio frequency interference (RFI), and may provide shielding from other types of interference as well to better control electrical characteristics, such as impedance, cross-talk, and the like, of the signal contacts 124. The contact modules 122 provide shielding for each pair of signal contacts 124 along substantially the entire length of the signal contacts 124 between the mating end 128 and the mounting end 130. The conductive insert 121 provides shielding for the signal contacts 124 proximate to the mating end 128. In an exemplary embodiment, the shield structure 126 is configured to be electrically connected to the header connector 106 and/or the circuit board 104. The shield structure 126 may be electrically connected to the circuit board 104 by features, such as grounding pins and/or surface tabs.

The front housing 120 includes a plurality of signal contact openings 132 and a plurality of ground contact openings 134 at the mating end 128. The signal contacts 124 are received in corresponding signal contact openings 132. Optionally, a single signal contact 124 is received in each signal contact opening 132. The signal contact openings 132 may also receive corresponding header signal contacts 112 (shown in FIG. 4) of the header connector 106. In the illustrated embodiment, the ground contact openings 134 are C-shaped extending along three sides of the corresponding pair of signal contact openings 132. The ground contact openings 134 receive header ground shields 114 of the header connector 106. The ground contact openings 134 also receive portions of the shield structure 126 (for example, beams and/or fingers) of the contact modules 122 that mate with the header ground shields 114 to electrically couple the shield structure 126 with the header connector 106.

The front housing 120 is manufactured from a dielectric material, such as a plastic material, and provides isolation between the signal contact openings 132 and the ground contact openings 134. The front housing 120 isolates the signal contacts 124 from the shield structure 126. The front housing 120 isolates each set (for example, differential pair) of signal contacts 124 from other sets of signal contacts 124.

The conductive insert 121 is manufactured from a conductive material, such as a metal material, and provides electrical shielding for the signal contacts 124 proximate to the mating interfaces of the signal contacts 124. For example, the conductive insert 121 is generally aligned with the mating plane between the signal contacts 124 and the header signal contacts 112 (for example, at a depth from the front 129). In other various embodiments, the conductive insert 121 may be a plated plastic component having metalized, plated surfaces.

FIG. 3 is a front perspective view of an electrical connector 302 in accordance with an exemplary embodiment. The electrical connector 302 is similar to the electrical connector 102; however, the electrical connector 302 has a different mating interface with the signal contacts being arranged as pair-in-row signal contacts for mating with the header connector 106 (shown in FIG. 1) or other similar mating electrical connector.

The electrical connector 302 includes a housing assembly 319 including a front housing 320 and a conductive insert 321 held by the front housing 320. The electrical connector 302 includes a plurality of contact modules 322 coupled to the housing assembly 319. The contact modules 322 are held in a stacked configuration generally parallel to one another. The contact modules 322 may be loaded into the conductive insert 321 and/or the front housing 320 side-by-side in the stacked configuration as a unit or group. The contact modules 322 each include a plurality of signal contacts 324 that define signal paths through the electrical connector 302. The signal contacts 324 are configured to be electrically connected to corresponding header signal contacts 112 of the header connector 106.

The electrical connector 302 includes a mating end 328, such as at a front 329 of the electrical connector 302, and a mounting end 330, such as at a bottom 331 of the electrical connector 302. In the illustrated embodiment, the mounting end 330 is oriented substantially perpendicular to the mating end 328. The mating and mounting ends 328, 330 may be at different locations other than the front 329 and bottom 331 in alternative embodiments, such as at a side, the rear or other locations. The signal contacts 324 extend through the electrical connector 302 from the mating end 328 to the mounting end 330 for mounting to the circuit board 304.

The signal contacts 324 are received in the front housing 320 and held therein at the mating end 328 for electrical termination to the header connector 106. The conductive insert 321 provides electrical shielding for portions of the signal contacts 324, such as proximate to the mating interfaces of the signal contacts 324. The signal contacts 324 are arranged in a matrix of rows and columns. In the illustrated embodiment, at the mating end 328, the rows are oriented horizontally and the columns are oriented vertically. Other orientations are possible in alternative embodiments. Any number of signal contacts 324 may be provided in the rows and columns. Optionally, the signal contacts 324 may be arranged in pairs carrying differential signals; however other signal arrangements are possible in alternative embodiments, such as single-ended applications. Optionally, the pairs of signal contacts 324 may be arranged in rows (pair-in-row signal contacts); however, the pairs of signal contacts may be arranged in columns (pair-in-column signal contacts, for example, as shown in FIG. 2) in alternative embodiments. In an exemplary embodiment, the signal contacts 324 within each pair are contained within the same contact module 322.

In an exemplary embodiment, each contact module 322 has a shield structure 326 for providing electrical shielding for the signal contacts 324. The conductive insert 321 forms part of the shield structure 326. The shield structure 326 is configured to be electrically connected to header ground shields 114 (shown in FIG. 4) of the header connector 106. The conductive insert 321 provides shielding for the signal contacts 324 proximate to the mating end 328. In an exemplary embodiment, the shield structure 326 is configured to be electrically connected to the header connector 106 and/or the circuit board 104.

The front housing 320 includes a plurality of signal contact openings 332 and a plurality of ground contact openings 334 at the mating end 328. The signal contacts 324 are received in corresponding signal contact openings 332. Optionally, a single signal contact 324 is received in each signal contact opening 332. The signal contact openings 332 may also receive corresponding header signal contacts 112 (shown in FIG. 4) of the header connector 106. In the illustrated embodiment, the ground contact openings 334 are C-shaped extending along three sides of the corresponding pair of signal contact openings 332. The ground contact openings 334 receive header ground shields 114 of the header connector 106. The ground contact openings 334 also receive portions of the shield structure 326 (for example, beams and/or fingers) of the contact modules 322 that mate with the header ground shields 114 to electrically couple the shield structure 326 with the header connector 106.

Figure 4:
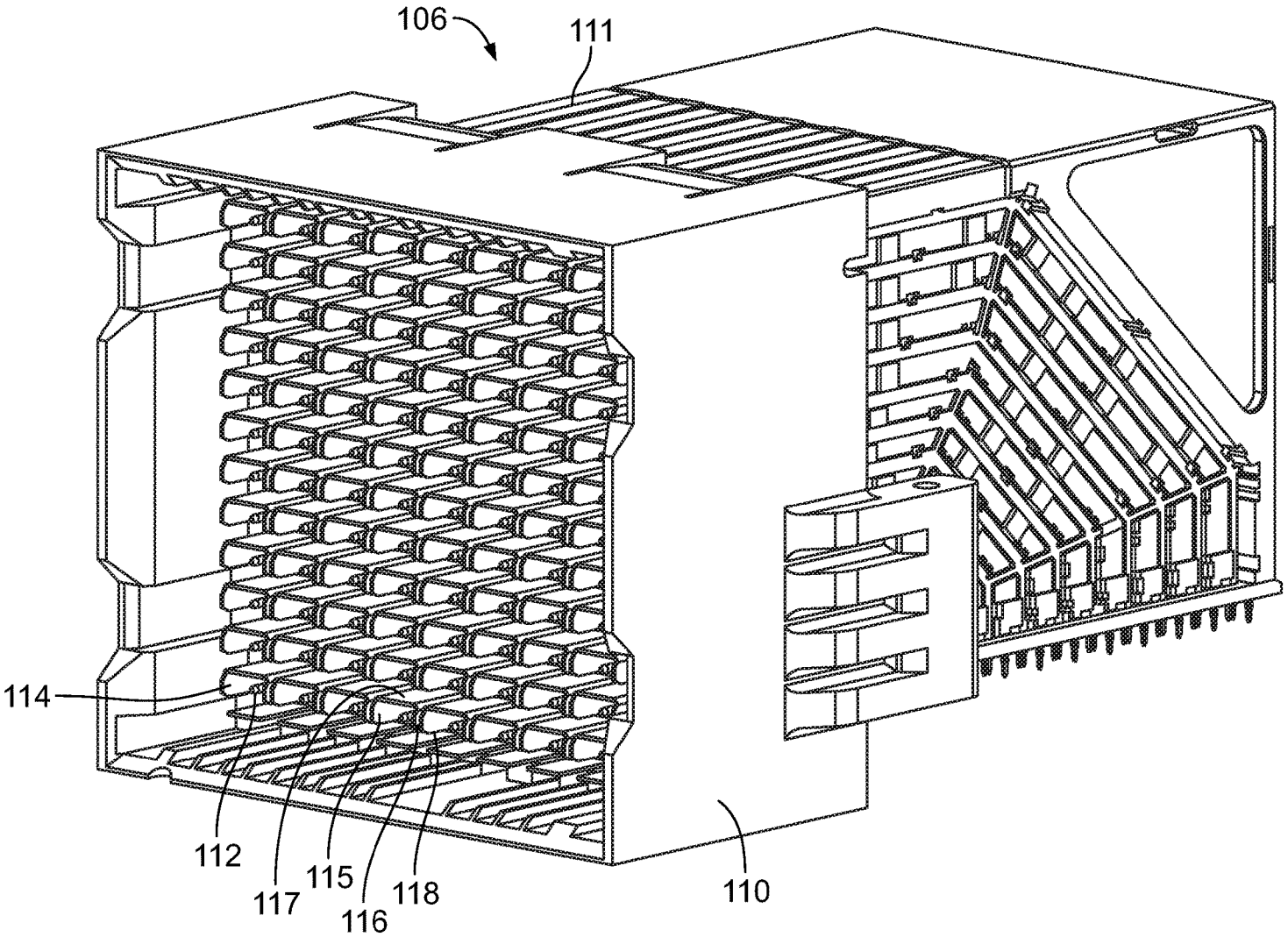
FIG. 4 is a front perspective view of a mating electrical connector in accordance with an exemplary embodiment.

FIG. 4 is a front perspective view of the header connector 106 in accordance with an exemplary embodiment. The header connector 106 includes a housing 110 holding a plurality of mating signal contacts or header signal contacts 112 and mating ground shields or header ground shields 114. In the illustrated embodiment, the header signal contacts 112 and the header ground shields 114 are held by corresponding contact modules 111 arranged in a stacked configuration. However, the header signal contacts 112 and/or the header ground shields 114 may be directly held by the header housing 110 rather than the contact modules 111 in alternative embodiments.

In various embodiments, the header signal contacts 112 may be arranged in pairs. Each header ground shield 114 extends around corresponding header signal contacts 112, such as the pairs of header signal contacts 112. In the illustrated embodiment, the header ground shields 114 are C-shaped having three walls extending along three sides of each pair of header signal contacts 112. For example, the header ground shields 114 include ends walls 115, 116 and a center wall 117 between the end walls 115, 116. The end walls 115, 116 have edges 118. The header ground shield 114 adjacent to the pair provides electrical shielding along a fourth side of the pair. As such, the pairs of header signal contacts 112 are circumferentially surrounded on all four sides by the header ground shields 114. The header ground shields 114 may have other shapes in alternative embodiments. The header ground shields 114 extend to edges 118.

Figure 5:
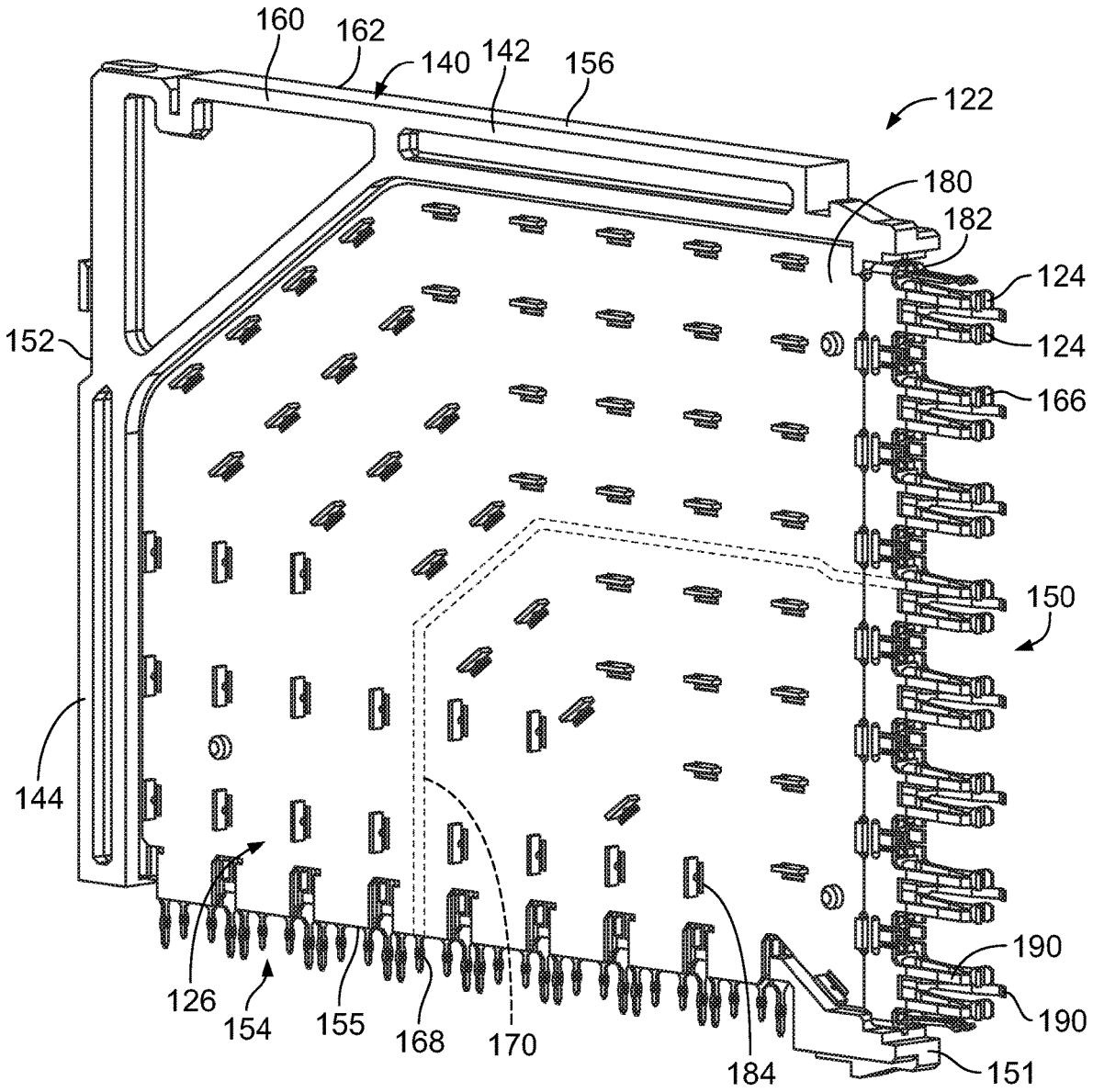
FIG. 5 illustrates a contact module of the electrical connector in accordance with an exemplary embodiment.
Figure 6:
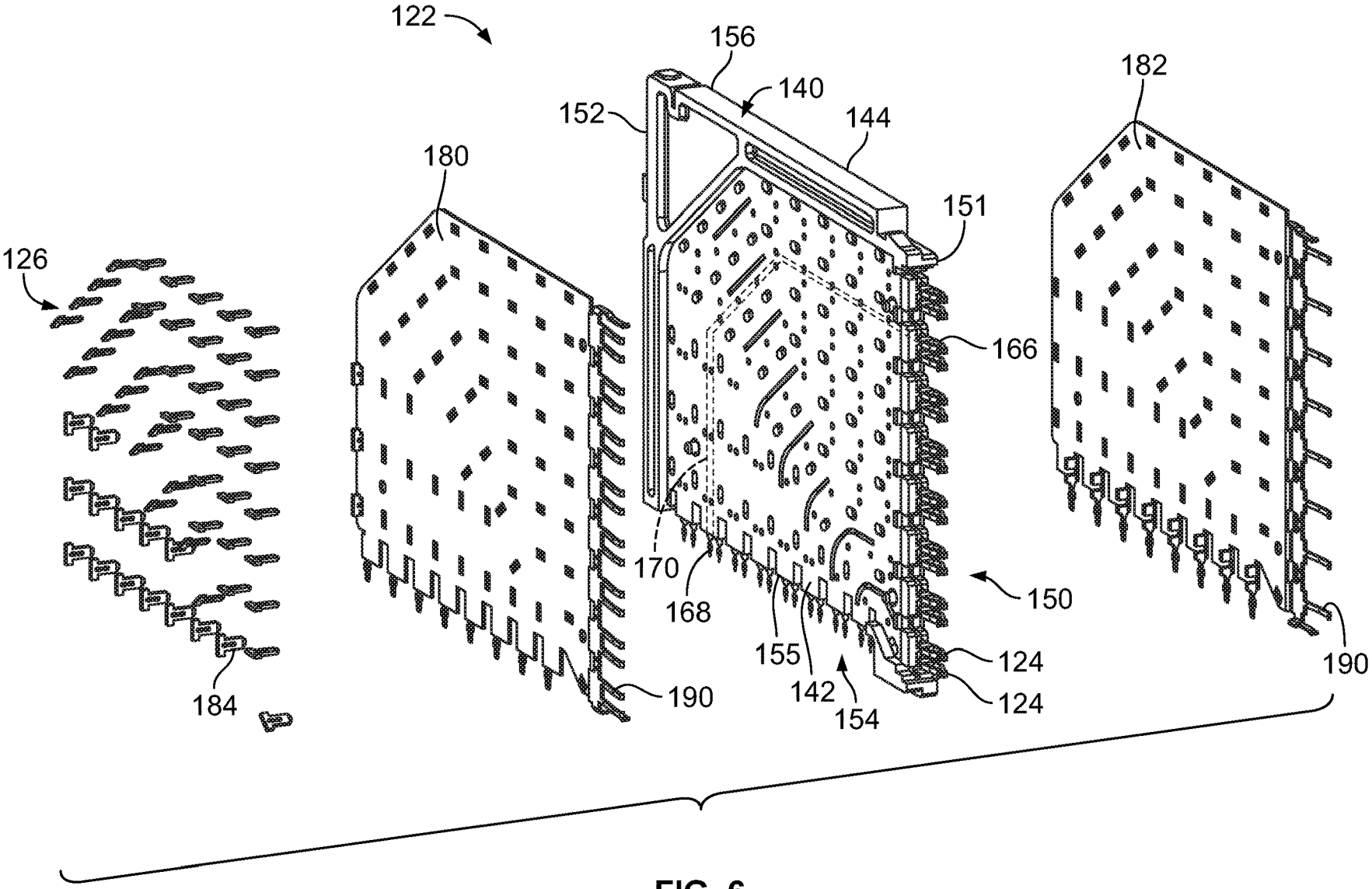
FIG. 6 is a partially exploded view of the contact module in accordance with an exemplary embodiment.

FIG. 5 illustrates one of the contact modules 122 in accordance with an exemplary embodiment. FIG. 6 is a partially exploded view of the contact module 122 in accordance with an exemplary embodiment. The contact module 122 includes a frame assembly 140 having an array of the signal contacts 124 and a dielectric holder 142 holding the signal contacts 124. The dielectric holder 142 generally surrounds the signal contacts 124 along substantially the entire length of the signal contacts 124 between the mounting end 130 at the bottom 131 and the mating end 128 at the front 129. The shield structure 126 is coupled to the dielectric holder 142 to provide electrical shielding for the signal contacts 124, such as for each pair of the signal contacts 124. The shield structure 126 provides circumferential shielding for each pair of signal contacts 124 along at least a majority of a length of the signal contacts 124, such as substantially an entire length of the signal contacts 124.

In an exemplary embodiment, the dielectric holder includes a dielectric body 144 surrounding the array of signal contacts 124. The dielectric body 144 may be overmolded over the signal contacts 124. Optionally, the signal contacts 124 may be initially formed from a leadframe and overmolded by the corresponding dielectric body 144 such that portions of the signal contacts 124 are encased in the dielectric holder 142. The dielectric holder 142 has a mating end 150 at a front 151 thereof configured to be loaded into the front housing 120 (shown in FIG. 1), a rear 152 opposite the mating end 150, a mounting end 154 at a bottom 155 which optionally may be adjacent to the circuit board 104 (shown in FIG. 1), and a top 156 generally opposite the mounting end 154.

The dielectric holder 142 includes first and second sides, such as a right side 160 and a left side 162. The shield structure 126 is coupled to both the right and left sides 160, 162. The signal contacts 124 are arranged in pairs aligned with each other and following similar paths that are radially offset from each other between the mating and mounting ends 128, 130.

The signal contacts 124 may be stamped and formed from a sheet of metal material. Each signal contact 124 has a mating portion 166 extending forward from the mating end 150 of the dielectric holder 142 and a mounting portion 168 extending downward from the mounting end 154. The mating and mounting portions 166, 168 are exposed beyond the front 151 and the bottom 155, respectively, of the dielectric holder 142. Each signal contact 124 has a transition portion 170 (one of which is shown in phantom in FIGS. 5 and 6) between the mating and mounting portions 166, 168. The transition portions 170 are configured to be shielded by the shield structure 126. The mating portions 166 are configured to be electrically terminated to corresponding header signal contacts 112 (shown in FIG. 4) when the electrical connector 102 is mated to the header connector 106 (shown in FIG. 4). The conductive insert 121 (shown in FIG. 2) is configured to provide electrical shielding for the mating portions 166. In an exemplary embodiment, the mounting portions 168 include compliant pins, such as eye-of-the-needle pins, configured to be terminated to the circuit board 104 (shown in FIG. 1).

In an exemplary embodiment, the shield structure 126 includes first and second ground shields 180, 182 and ground skewers 184 used to electrically connect the first and second ground shields 180, 182 to each other and/or to guard traces in the dielectric body 144, which form part of the shield structure 126. The first ground shield 180 is positioned along the right side 160 of the dielectric holder 142, and as such, may be hereinafter referred to as the right ground shield 180. The second ground shield 182 is positioned along the left side 162 of the dielectric holder 142, and may be hereinafter referred to as the left ground shield 182.

The first and second ground shields 180, 182 are provided along right and left sides of each of the mating portions 166 of the pairs of signal contacts 124 to provide electrical shielding between the pairs of signal contacts 124 in adjacent contact modules 122. For example, the ground shields 180, 182 include mating portions 190 extending forward from the main bodies of the ground shields 180, 182. The mating portions 190 may be deflectable spring beams having mating interfaces configured to engage and electrically connect to corresponding header ground shields 114. The first and second ground shields 180, 182 electrically connect the contact module 122 to the header connector 106, such as to the header ground shields 114 thereof, thereby providing an electrical ground path between the electrical connector 102 and the header connector 106.

In an exemplary embodiment, the conductive insert 121 is configured to extend across the fronts 151 of the dielectric holders 142 to provide shielding for the mating portions 166 of the signal contacts 124. The mating portions 190 are configured to extend into the conductive insert 121. The first and second ground shields 180, 182 may be electrically connected to the conductive insert 121 when loaded into the conductive insert 121 and the front housing 120. The first and second ground shields 180, 182 electrically connect the contact module 122 to the circuit board 104, such as through compliant pins thereof. The first and second ground shields 180, 182 may be similar and include similar features and components. As such, the description below may include description of either ground shield, which may be relevant to the other ground shield, and like components may be identified with like reference numerals.

Figure 7:
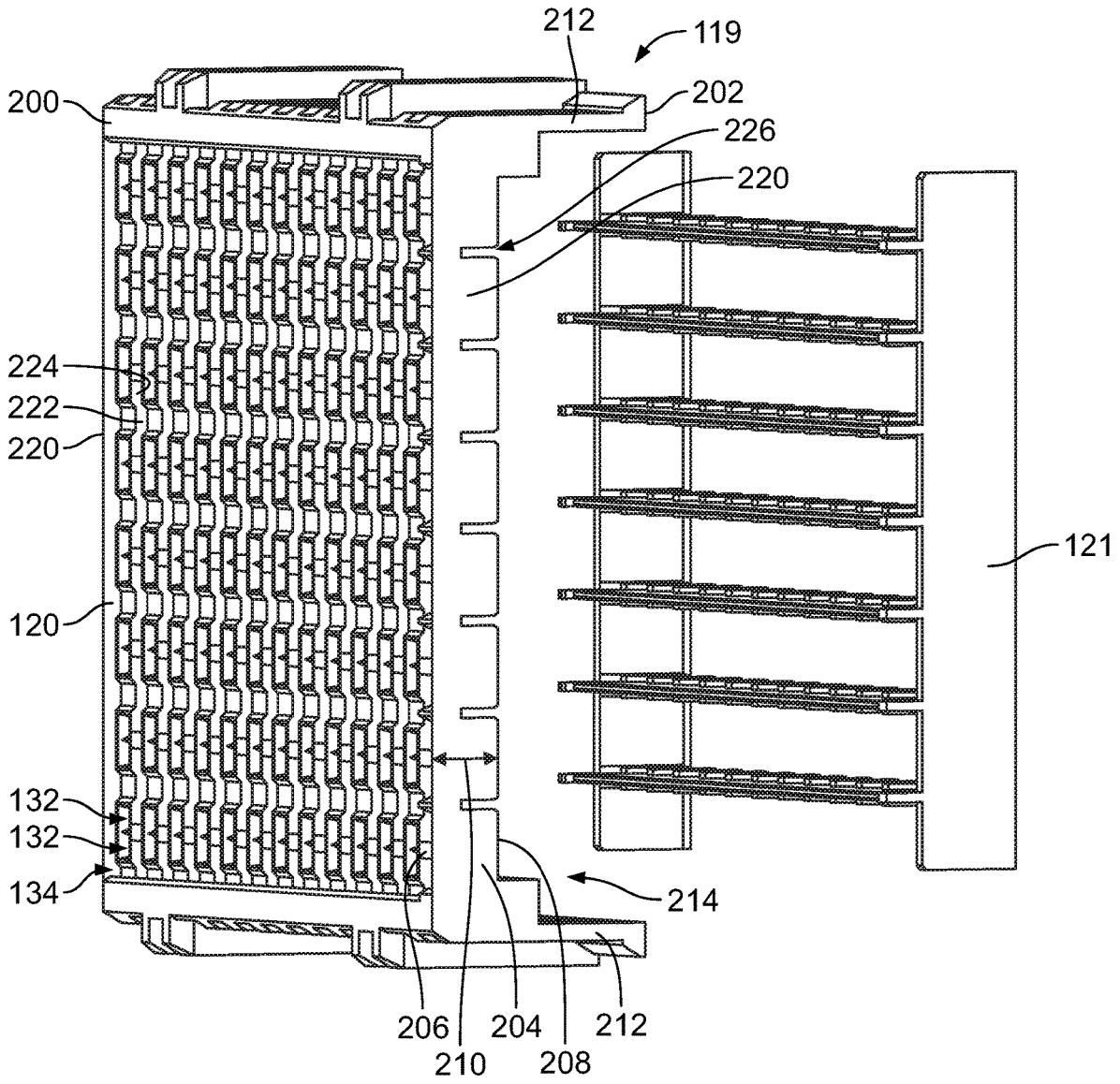
FIG. 7 is an exploded, front perspective view of a housing assembly of the electrical connector showing a front housing and a conductive insert in accordance with an exemplary embodiment.

FIG. 7 is an exploded, front perspective view of the housing assembly 119 showing the front housing 120 and the conductive insert 121 in accordance with an exemplary embodiment. The front housing 120 extends between a front 200 and a rear 202. The front housing 120 includes a panel 204 at the front 200. The panel 204 includes a front surface 206 and a rear surface 208. The front surface 206 defines the front 200 of the front housing 120.

The panel 204 has a panel thickness 210 between the front surface 206 and the rear surface 208. The signal contact openings 132 and the ground contact openings 134 extend through the panel 204 between the front surface 206 and the rear surface 208. The front housing 120 includes wings 212 extending rearward from the top and the bottom of the panel 204. The front housing 120 includes a cavity 214 at the rear 202. The cavity 214 is defined between the wings 212. The cavity 214 may extend into the rear surface 208 of the panel 204. The conductive insert 121 is received in the cavity 214. In an exemplary embodiment, the cavity 214 receives the contact modules 122 (shown in FIG. 2).

In an exemplary embodiment, the front housing 120 includes end walls 220 extending between the wings 212. The end walls 220 are provided on opposite sides of the front housing 120. In the illustrated embodiment, the end walls 220 extend vertically. The front housing 120 includes cross walls 222 extending between the end walls 220. The cross walls 222 are oriented perpendicular to the end walls 220. In the illustrated embodiment, the cross walls 222 extend horizontally. The front housing 120 includes strengthening walls 224 extending between the cross walls 222. The strengthening walls 224 are oriented perpendicular to the cross walls 222. The strengthening walls 224 may be oriented parallel to the end walls 220. In an exemplary embodiment, the cross walls 222 are horizontal cross walls and the strengthening walls 224 are vertical cross walls. The end walls 220, the cross walls 222 and the strengthening walls 224 create a grid having openings defining the signal contact openings 132 and the ground contact openings 134. The end walls 220, the cross walls 222 and the strengthening walls 224 are integral with each other. For example, the end walls 220, the cross walls 222 and the strengthening walls 224 may be co-molded with the wings 212 to form the front housing 120.

In an exemplary embodiment, the panel 204 includes slots 226 along the rear surface 208 that receive the conductive insert 121. For example, the slots 226 may be formed in the end walls 220 and/or the cross walls 222 and/or the strengthening walls 224. The slots 226 allow loading of the conductive insert 121 into the front housing 120. For example, portions of the conductive insert 121 may be inset into the panel 204 of the front housing 120.

Figure 8:
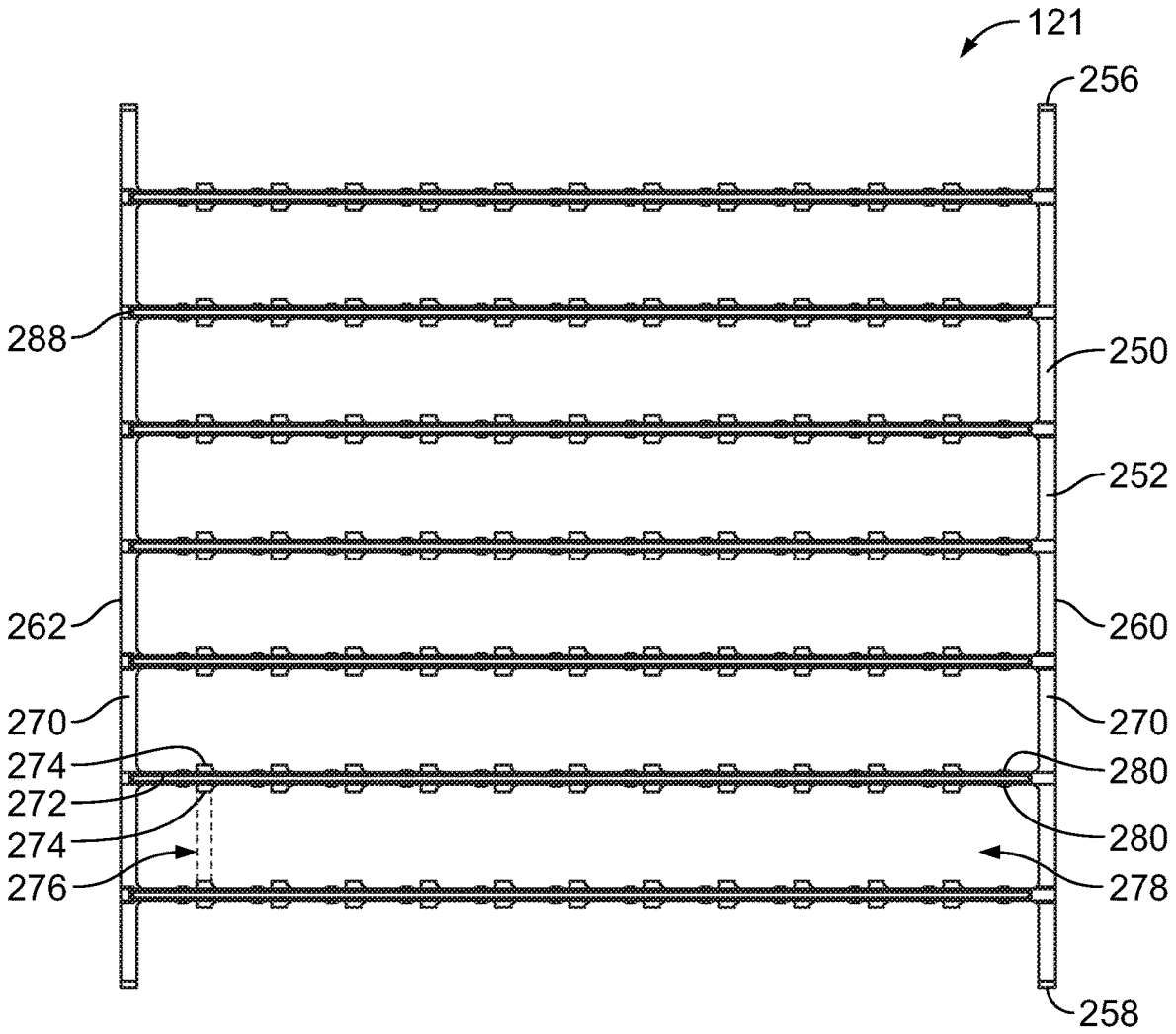
FIG. 8 is a front view of the conductive insert in accordance with an exemplary embodiment.
Figure 9:
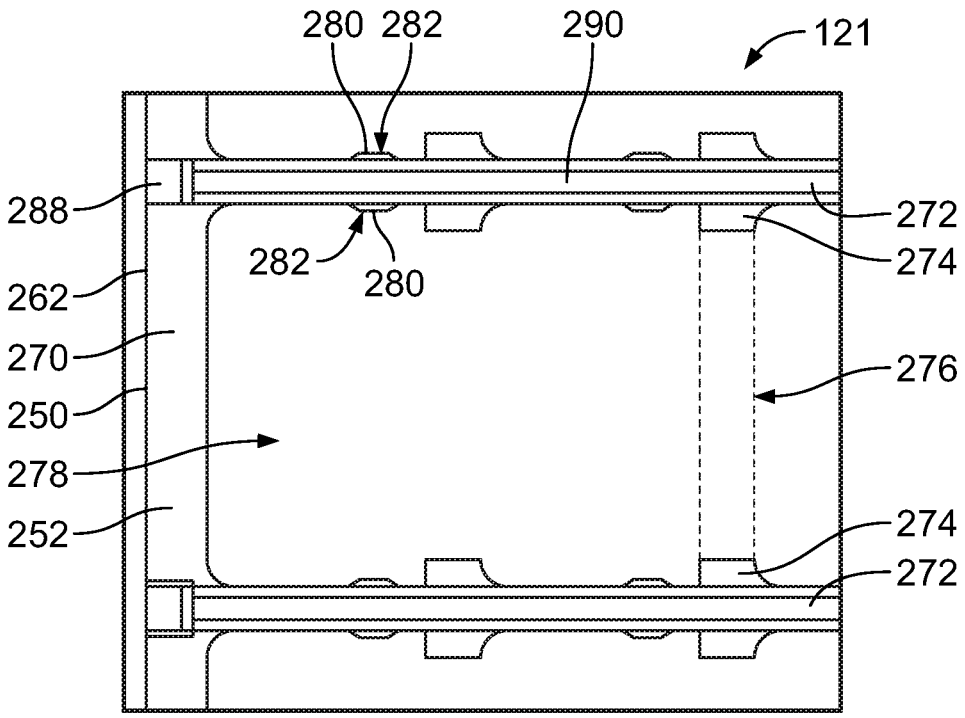
FIG. 9 is an enlarged, front view of a portion of the conductive insert in accordance with an exemplary embodiment.
Figure 10:
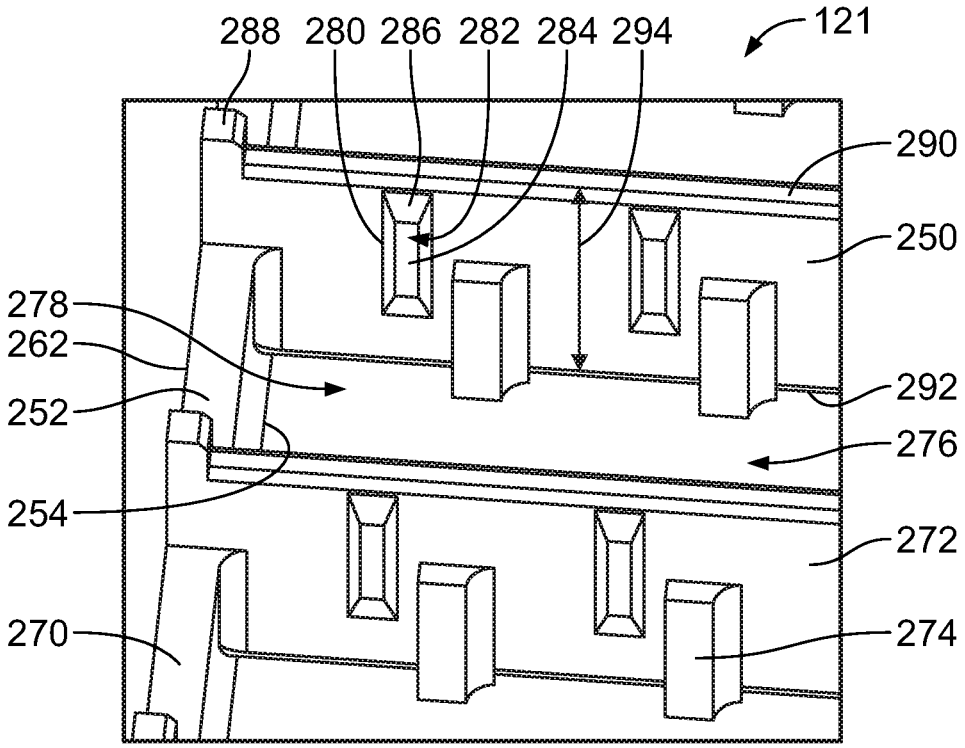
FIG. 10 is a front perspective view of a portion of the conductive insert in accordance with an exemplary embodiment.

FIG. 8 is a front view of the conductive insert 121 in accordance with an exemplary embodiment. FIG. 9 is an enlarged, front view of a portion of the conductive insert 121. FIG. 10 is a front perspective view of a portion of the conductive insert 121. The conductive insert 121 includes a body 250 extending between a front 252 and a rear 254. The body 250 extends between a top 256 and a bottom 258. The body 250 has a first side 260 and a second side 262.

In an exemplary embodiment, the conductive insert 121 includes end walls 270 on the opposite sides 260, 262 of the conductive insert 121. In the illustrated embodiment, the end walls 270 extend vertically. The conductive insert 121 includes cross walls 272 extending between the end walls 270. The cross walls 272 are oriented perpendicular to the end walls 270. In the illustrated embodiment, the cross walls 272 extend horizontally. In an exemplary embodiment, the conductive insert 121 includes strengthening walls 274 extending from the cross walls 272. The strengthening walls 274 are oriented perpendicular to the cross walls 272. In the illustrated embodiment, the strengthening walls 274 extend only partially between the cross walls 272 such that gaps 276 are defined between the strengthening walls 274 on opposite cross walls 272. In alternative embodiments, the strengthening walls 274 may extend entirely between and connect the opposite cross walls 272. The end walls 270, the cross walls 272 and the strengthening walls 274 are integral with each other. For example, the end walls 270, the cross walls 272 and the strengthening walls 274 may be extruded, molded or machined from a single piece of metal. The end walls 270, the cross walls 272 and the strengthening walls 274 may be plated plastic walls in other various embodiments.

The cross walls 272 define channels 278 between the opposite cross walls 272. The channels 278 are configured to receive corresponding header ground shields 114 (shown in FIG. 4). The cross walls 272 are configured to electrically couple to the header ground shields 114 in the channels 278. In the illustrated embodiment, the channels 278 extend between the end walls 270. When the strengthening walls 274 extend entirely between the cross walls, the channels 278 may be separated into subchannels. Channels 278 may be provided above the uppermost cross wall 272 and/or below the lowermost cross wall 272.

In an exemplary embodiment, the conductive insert 121 includes protrusions 280 extending into the channels 278. Each protrusion 280 includes a mating interface 282 configured to engage the corresponding header ground shield 114 for a direct electrical connection therebetween. In alternative embodiments, the conductive insert 121 may be devoid of the protrusions 280, rather relying upon proximity of the conductive insert and the header ground shields 114 over large surface areas to create capacitive coupling between the conductive insert 121 and the header ground shields 114 to electrically couple the conductive insert 121 and the header ground shields 114. The protrusions 280 may be positioned proximate to strengthening walls 274. In an exemplary embodiment, the protrusions 280 are provided on both sides of the cross wall 272, such as the top side and the bottom side of the cross wall 272. In other various embodiments, the protrusions 280 are provided on only the top side or only the bottom side of the cross wall 272. In an exemplary embodiment, the protrusions 280 include flat surfaces 284 defining the mating interfaces 282 and ramp surfaces 286 extending between the flat surfaces 284 and the cross walls 272. The ramp surfaces 286 guide mating with the header ground shields 114. The flat surfaces 284 provide an area of large surface area for mating with the header ground shields 114.

The conductive insert 121 includes locating ribs 288 for locating the conductive insert 121 relative to the front housing 120. The locating ribs 288 are configured to be received in corresponding slots 226 (shown in FIG. 7) of the front housing 120. In the illustrated embodiment, the locating ribs 288 are provided at the front 252 of the conductive insert 121. The locating ribs 288 may extend forward from the end walls 270 and/or the cross walls 272 and/or the strengthening walls 274.

In an exemplary embodiment, the cross walls 272 extend between a front surface 290 and a rear surface 292. The cross walls 272 have cross wall thicknesses 294 between the front surfaces 290 and the rear surfaces 292. Optionally, the cross wall thicknesses 294 may be approximately equal to the panel thickness 210 of the panel 204 of the front housing 120 (shown in FIG. 7). In various embodiments, the cross wall thicknesses 294 are thicker than the panel thickness 210. As such, the cross walls 272 define a significant depth of the housing assembly 119 to provide electrical shielding along a significant portion of the signal contacts 124 extending through the front housing portion. In the illustrated embodiment, the front surfaces 290 of the cross walls 272 are located forward of the front of the end wall 270. As such, the cross wall 272 is configured to extend into the panel 204 of the front housing 120, such as into a corresponding slot 226 in the rear of the panel 204 of the front housing 120. In the illustrated embodiment, the end walls 270 extend rearward of the rear surface 292; however, the cross walls 272 may extend rearward of the end walls 270 or may be flush with the rear of the end walls 270.

The protrusions 280 extend at least partially between the front surface 290 and the rear surface 292. In an exemplary embodiment, the protrusions 280 are positioned proximate to the front surface 290 to position the protrusions 280 close to the front 252 and close to the front housing 120. The strengthening walls 274 extend at least partially between the front surface 290 and the rear surface 292. In the illustrated embodiment, the strengthening walls 274 are thinner than the cross walls 272 and located proximate to the rear surface 292; however, the strengthening walls 274 may have the same thickness as the cross walls 272 or may be wider than the cross walls 272. In other various embodiments, strengthening walls 274 may be located at the front surface 290. In the illustrated embodiment, the fronts of the strengthening walls 274 are coplanar with the fronts of the end walls 270 and the cross walls 272 extend forward of the fronts of the end walls 270 and the strengthening walls 274 such that the cross walls 272 may be received in corresponding slots 226 of the panel 204 of the front housing 120.

Figure 11:
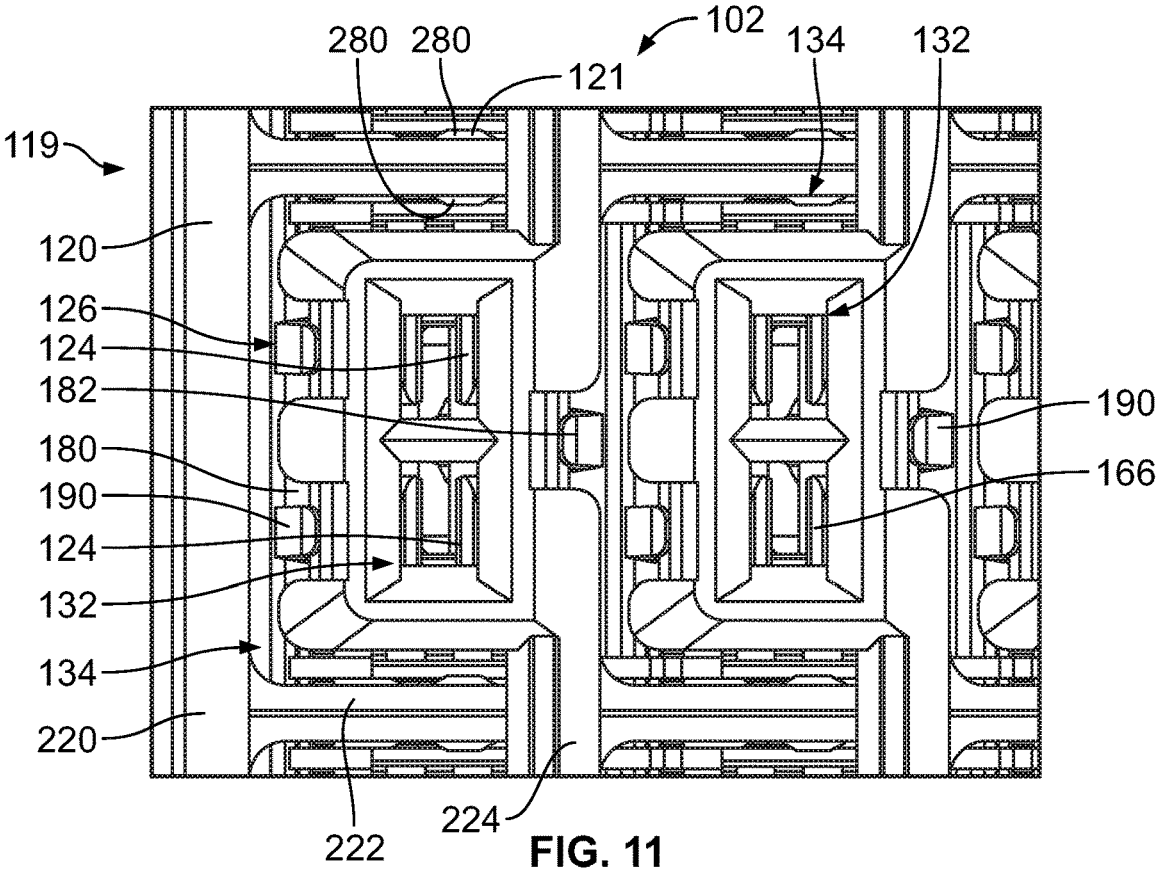
FIG. 11 is a front view of a mating interface of the electrical connector showing the housing assembly in accordance with an exemplary embodiment.
Figure 12:
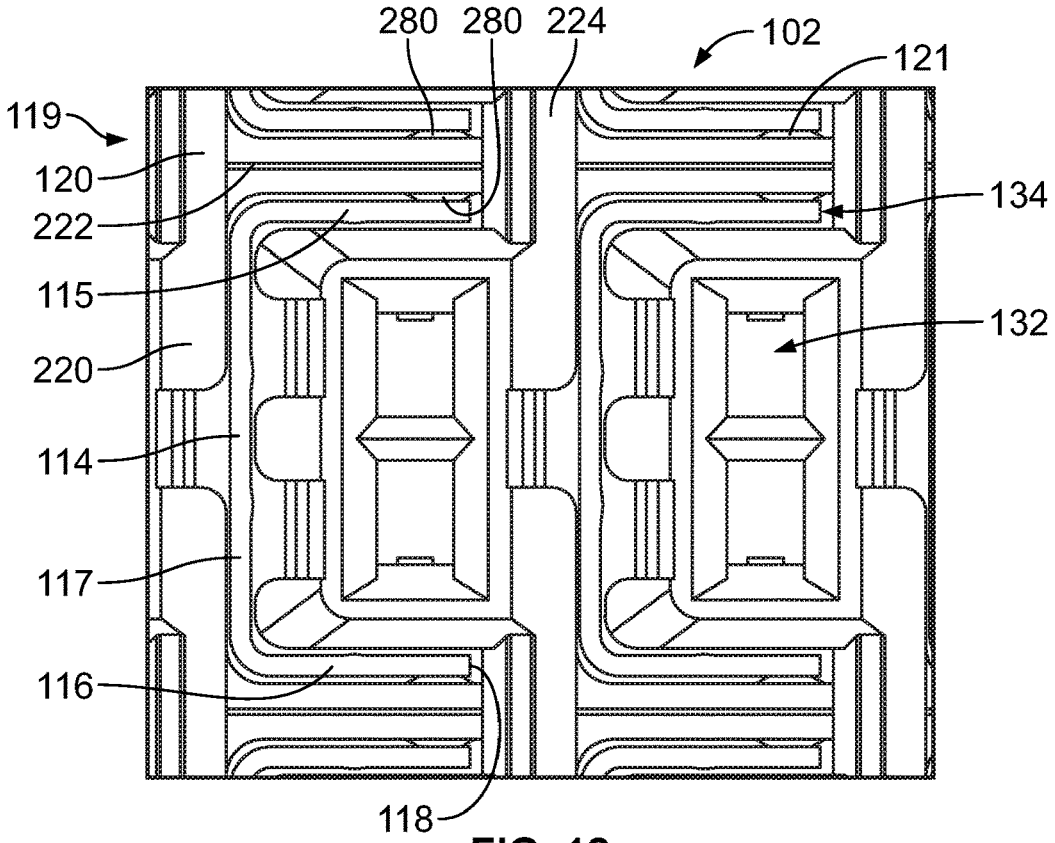
FIG. 12 is a front view of the housing assembly of the electrical connector in accordance with an exemplary embodiment and showing header ground shields.

FIG. 11 is a front view of the mating interface of the electrical connector 102 showing the housing assembly 119 and the shield structure 126. FIG. 12 is a front view of the housing assembly 119 of the electrical connector 102 and showing the header ground shields 114 relative to the shield structure 126. The header ground shields 114 (FIG. 12) are received in the ground contact openings 134 and coupled to the shield structure 126 in the ground contact openings 134. For example, the header ground shields 114 may be directly electrically connected or may be capacitively coupled to electrically couple the header ground shields 114 to the shield structure 126. The mating portions 166 (FIG. 11) of the signal contacts 124 are received in corresponding signal contact openings 132 of the front housing 120.

The conductive insert 121 is positioned rearward of the front housing 120. The end walls 270 are aligned with the end walls 220, the cross walls 272 are aligned with the cross walls 222 and the strengthening walls 274 are aligned with the strengthening walls 224. The channels 278 are aligned with the ground contact openings 134 and the signal contact openings 132. The conductive insert 121 is positioned such that the protrusions 280 are aligned with the ground contact openings 134 to interface with the header ground shields 114 when the header ground shields 114 are received in the ground contact openings 134. The mating portions 190 of the ground shields 180, 182 are aligned with the ground contact openings 134 to interface with the header ground shields 114 when the header ground shields 114 are received in the ground contact openings 134.

In an exemplary embodiment, the protrusions 280 are configured to engage both end walls 115, 116 of each header ground shield 114. For example, the protrusions 280 engage the outer surfaces of the end walls 115, 116 proximate to the edges 118. In an exemplary embodiment, the protrusions 280 are positioned relative to the header ground shields 114 to engage the end walls 115, 116 and flex the end walls 115, 116 inward towards each other when the header ground shields 114 are received in the ground contact openings 134. For example, the spacing between the protrusions 280 on the opposite cross walls 272 may be less than the height of the header ground shield 114 such that the end walls 115, 116 are squeezed inward when the header ground shield 114 is loaded into the ground contact opening 134. Such an arrangement ensures electrical connection between the conductive insert 121 and the header ground shields 114. In an exemplary embodiment, the conductive insert 121 is configured to engage and electrically common each of the header ground shields 114 of the header connector 106. The protrusions 280 are positioned in close proximity to the mating interfaces between the mating portions 166 and the header signal contacts 112 and/or the mating portions 190 of the ground shields 180, 182 and the header ground shields 114.

Figure 13:
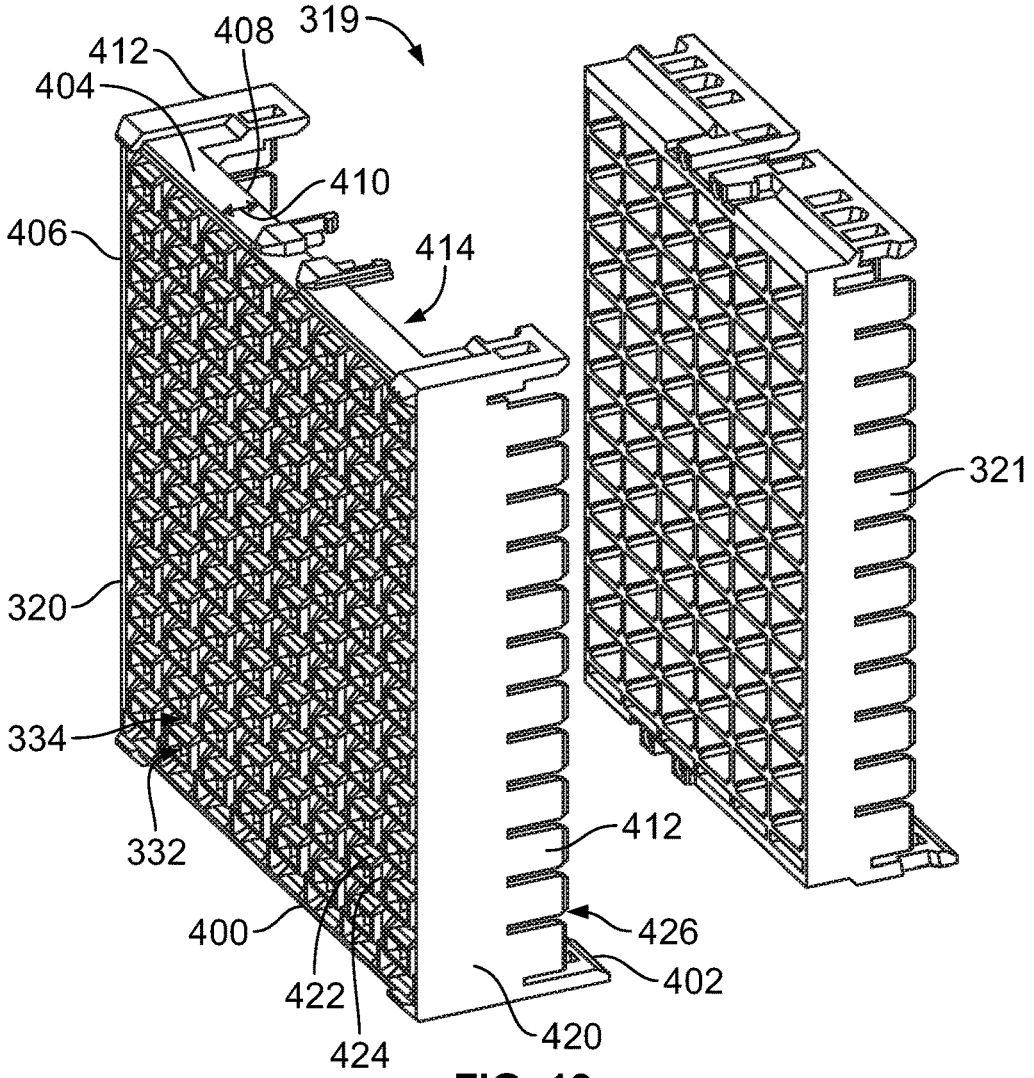
FIG. 13 is an exploded, front perspective view of a housing assembly showing a front housing and a conductive insert in accordance with an exemplary embodiment.

FIG. 13 is an exploded, front perspective view of the housing assembly 319 showing the front housing 320 and the conductive insert 321 in accordance with an exemplary embodiment. The front housing 320 extends between a front 400 and a rear 402. The front housing 320 includes a panel 404 at the front 400. The panel 404 includes a front surface 406 and a rear surface 408. The panel 404 has a panel thickness 410 between the front surface 406 and the rear surface 408.

The signal contact openings 332 and the ground contact openings 334 extend through the panel 404 between the front surface 406 and the rear surface 408. The front housing 320 includes wings 412 extending rearward from the sides of the panel 404. The front housing 320 includes a cavity 414 at the rear 402. The cavity 414 is defined between the wings 412. The cavity 414 may extend into the rear surface 408 of the panel 404. The conductive insert 321 is received in the cavity 414. In an exemplary embodiment, the cavity 414 receives the contact modules 322 (shown in FIG. 3).

In an exemplary embodiment, the front housing 320 includes end walls 420 at the sides. In the illustrated embodiment, the end walls 420 extend vertically. The front housing 320 includes cross walls 422 extending between the end walls 420. The cross walls 422 are oriented perpendicular to the end walls 420. In the illustrated embodiment, the cross walls 422 extend horizontally. The front housing 320 includes strengthening walls 424 extending between the cross walls 422. The strengthening walls 424 are oriented perpendicular to the cross walls 422. The strengthening walls 424 may be oriented parallel to the end walls 420. The end walls 420, the cross walls 422 and the strengthening walls 424 create a grid having openings defining the signal contact openings 332 and the ground contact openings 334.

In an exemplary embodiment, the panel 404 includes slots 426 along the rear surface 408 that receive features of the contact modules 322. For example, the slots 426 may be formed in the end walls 420 and/or the cross walls 422 and/or the strengthening walls 424. The slots 426 allow loading of the contact modules 322 into the front housing 320. For example, portions of the contact modules 322 may be inset into the panel 404 of the front housing 320.

Figure 16:
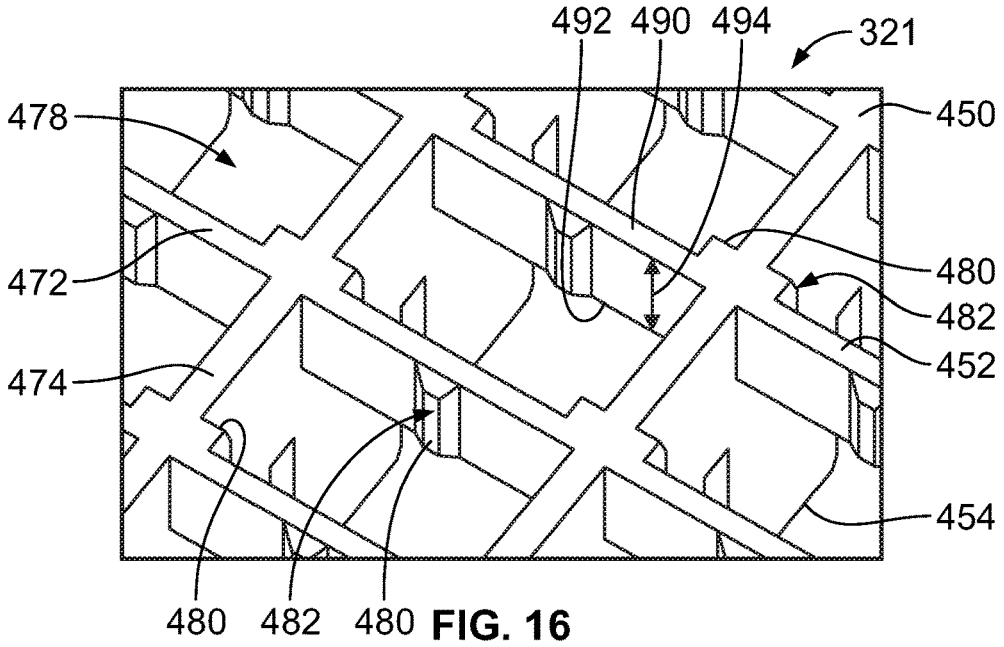
FIG. 16 is a front perspective view of a portion of the conductive insert in accordance with an exemplary embodiment.
Figure 14:
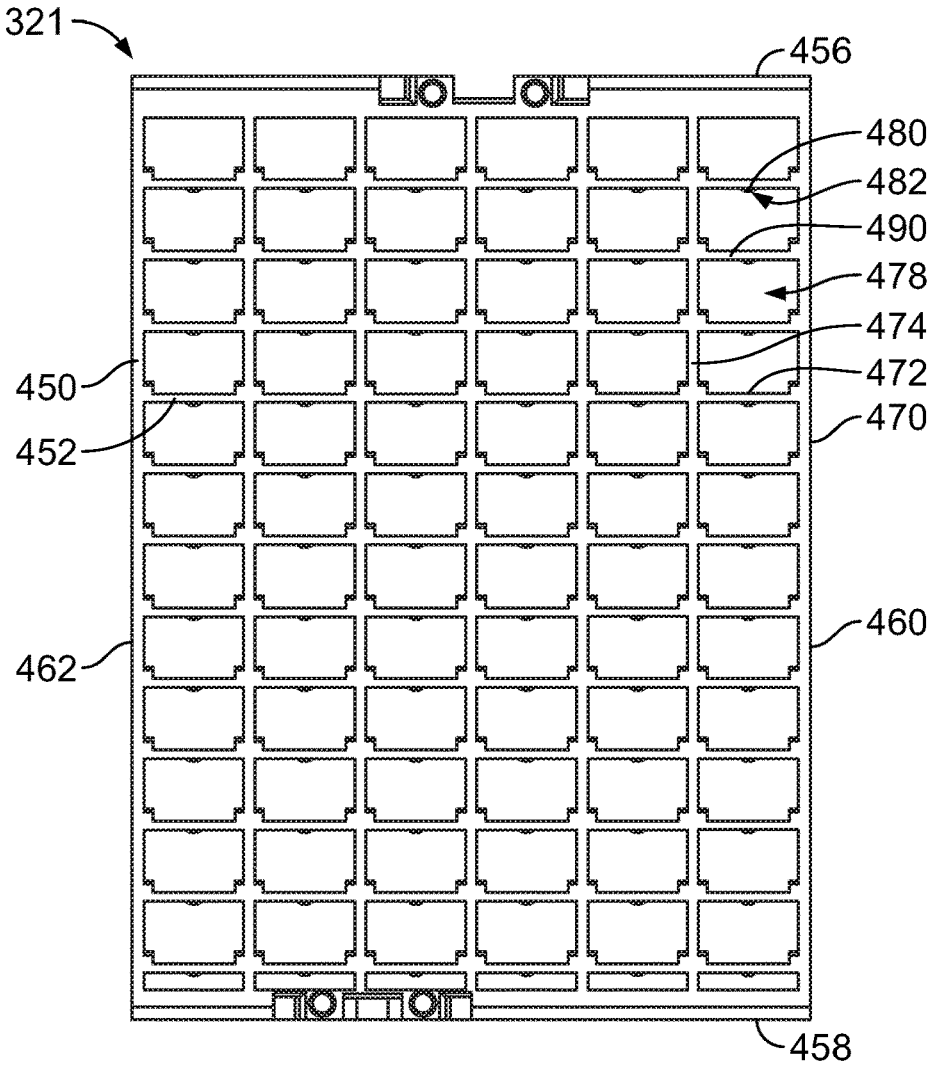
FIG. 14 is a front view of the conductive insert in accordance with an exemplary embodiment.
Figure 15:
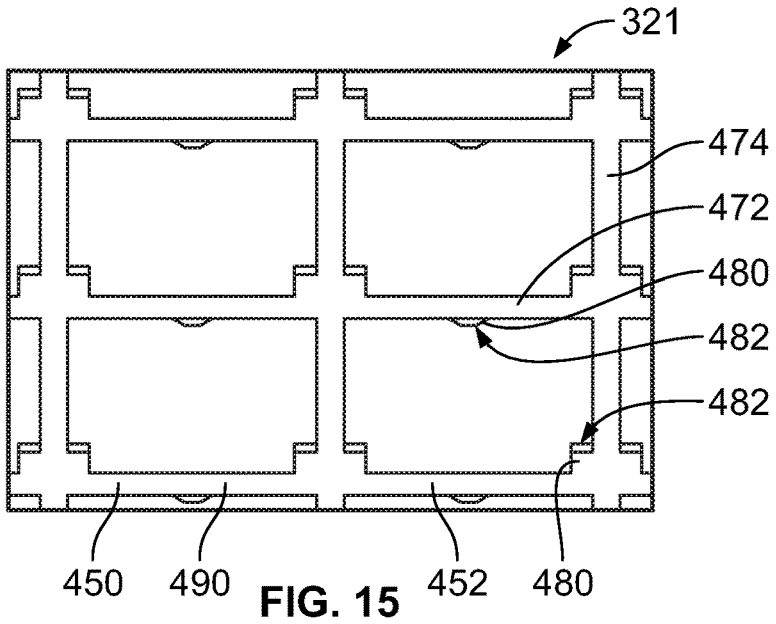
FIG. 15 is an enlarged, front view of a portion of the conductive insert in accordance with an exemplary embodiment.

FIG. 14 is a front view of the conductive insert 321 in accordance with an exemplary embodiment. FIG. 15 is an enlarged, front view of a portion of the conductive insert 321. FIG. 16 is a front perspective view of a portion of the conductive insert 321. The conductive insert 321 includes a body 450 extending between a front 452 and a rear 454. The body 450 extends between a top 456 and a bottom 458. The body 450 has a first side 460 and a second side 462. In an exemplary embodiment, the conductive insert 321 includes end walls 470 on the opposite sides 460, 462 of the conductive insert 321. The conductive insert 321 includes cross walls 472 extending between the end walls 470. In an exemplary embodiment, the conductive insert 321 includes strengthening walls 474 extending from the cross walls 472. In the illustrated embodiment, the strengthening walls 474 entirely between and connect the opposite cross walls 472.

The conductive insert 321 includes channels 478 between the cross walls 472 and between the strengthening walls 474. The channels 478 are configured to receive corresponding header ground shields 114 (shown in FIG. 4). The cross walls 472 and/or the strengthening walls 474 are configured to be electrically coupled to the header ground shields 114 in the channels 478. For example, the cross walls 472 and/or the strengthening walls 474 may directly engage the header ground shields 114 to electrically couple the conductive insert 321 and the header ground shields 114. In alternative embodiments, the conductive insert 321 may rely upon proximity of the conductive insert 321 and the header ground shields 114 over large surfaces areas to create capacitive coupling between the conductive insert 321 and the header ground shields 114 to electrically couple the conductive insert 321 and the header ground shields 114.

In an exemplary embodiment, the conductive insert 321 includes protrusions 480 extending into the channels 478. Each protrusion 480 includes a mating interface 482 configured to engage the corresponding header ground shield 114. In an exemplary embodiment, the protrusions 480 are provided on one or both sides of the cross walls 472. The conductive insert 321 may include locating features for locating the conductive insert 321 relative to the front housing 320. The protrusions 480 may directly engage the header ground shields 114 to electrically couple the conductive insert 321 to the header ground shields 114. In alternative embodiments, the conductive insert 321 may be devoid of the protrusions 480, rather relying upon capacitive coupling to electrically couple the conductive insert 321 and the header ground shields 114.

In an exemplary embodiment, the cross walls 472 extend between a front surface 490 and a rear surface 492. The cross walls 472 have cross wall thicknesses 494 between the front surfaces 490 and the rear surfaces 492. Optionally, the cross wall thicknesses 494 may be approximately equal to the panel thickness 410 of the panel 404 of the front housing 320 (shown in FIG. 13).

Figure 17:
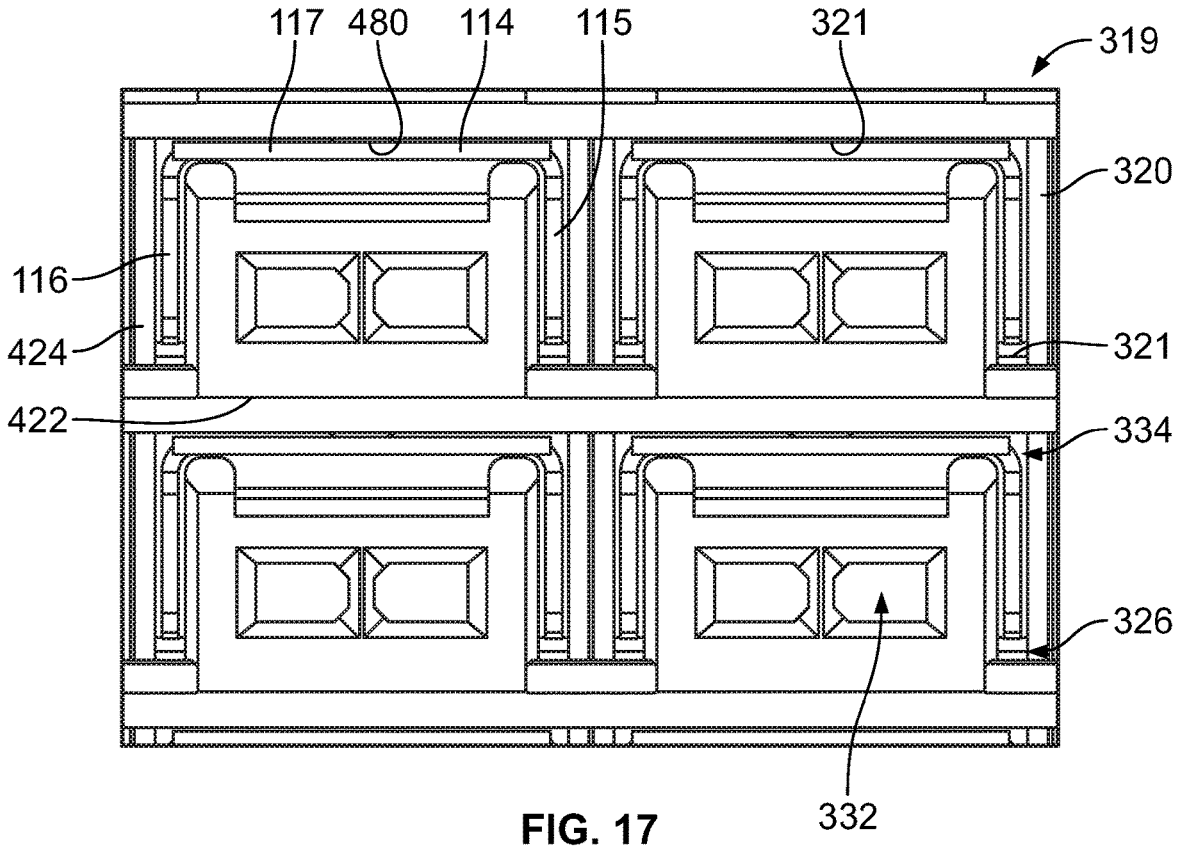
FIG. 17 is a front view of a mating interface of the electrical connector in accordance with an exemplary embodiment.
Figure 18:
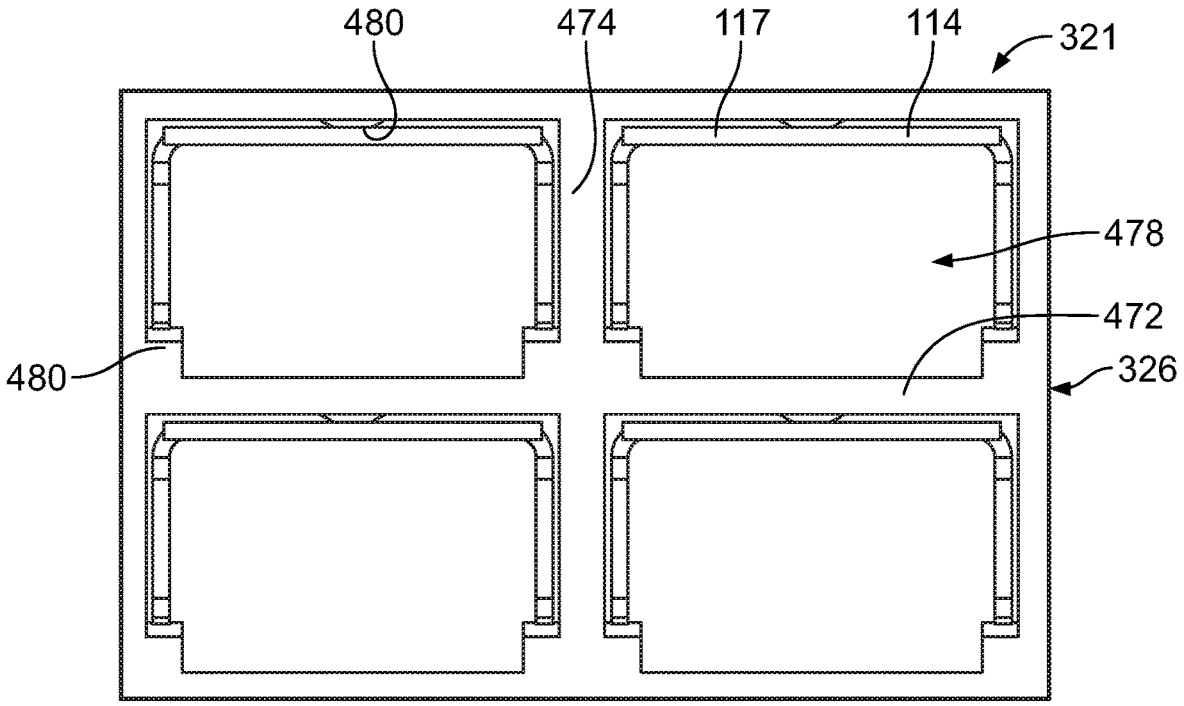
FIG. 18 is a front view of the conductive insert in accordance with an exemplary embodiment and showing header ground shields relative to the conductive insert.

FIG. 17 is a front view of the mating interface of the electrical connector 302 showing the housing assembly 319 and showing the header ground shields 114 relative to the shield structure 326. FIG. 18 is a front view of the conductive insert 321 and showing the header ground shields 114 relative to the conductive insert 321. The header ground shields 114 are received in the ground contact openings 334 (FIG. 17) and coupled to the shield structure 326 in the ground contact openings 334.

The conductive insert 321 is positioned rearward of the front housing 320. The end walls 470 are aligned with the end walls 420, the cross walls 472 are aligned with the cross walls 422 and the strengthening walls 474 are aligned with the strengthening walls 424. The channels 478 are aligned with the ground contact openings 334 and the signal contact openings 332. The conductive insert 321 is positioned such that the protrusions 480 are aligned with the ground contact openings 334 to interface with the header ground shields 114 when the header ground shields 114 are received in the ground contact openings 334. The mating portions 190 of the ground shields 180, 182 are aligned with the ground contact openings 334 to interface with the header ground shields 114 when the header ground shields 114 are received in the ground contact openings 334.

In an exemplary embodiment, the protrusions 480 are configured to engage the center walls 117 of each header ground shield 114. For example, the protrusions 480 engage the outer surfaces of the center walls 117. In an exemplary embodiment, the protrusions 480 are positioned relative to the header ground shields 114 to engage the center walls 117 and either flex the center walls 117 inward towards the header signal contacts 112 or flex the cross walls 272 outward when the header ground shields 114 are received in the ground contact openings 334. Such an arrangement ensures electrical connection between the conductive insert 321 and the header ground shields 114. In an exemplary embodiment, the conductive insert 321 is configured to electrically couple each of the header ground shields 114 of the header connector 106.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f) unless and until such claim limitations expressly use the phrase "means for" followed by a statement of function void of further structure.

What is claimed is:

1. An electrical connector for mating with a mating connector, the electrical connector comprising:

a front housing having a front and a rear, the front housing configured to hold signal contacts, the front housing having a cavity at the rear, the front configured to be mated with the mating connector; and a conductive insert received in the cavity, the conductive insert including end walls and cross walls extending between the end walls, the conductive insert includes channels between the cross walls, the channels configured to receive ground shields used to provide electrical shielding for the signal contacts, the cross walls configured to be electrically coupled to the corresponding ground shields, wherein the conductive insert is configured to electrically couple each of the ground shields.

2. The electrical connector of claim 1, wherein the cross walls are capacitively coupled to the ground shields.

3. The electrical connector of claim 1, wherein the cross walls include protrusions configured to directly engage and electrically connect to the ground shields.

4. The electrical connector of claim 1, wherein the conductive insert includes strengthening walls extending from the cross walls.

5. The electrical connector of claim 1, further comprising a contact module received in the cavity, the contact module having a frame assembly including an array of signal contacts and a dielectric holder holding the array of signal contacts, each signal contact having a mating end extending into the front housing for mating with a mating signal contact of the mating connector, the contact module having a ground shield coupled to the dielectric holder providing electrical shielding for the signal contacts, the ground shield having mating beams extending forward of the dielectric holder into the corresponding channel of the conductive insert, the mating beams extending into the front housing for mating with ground shields of the mating connector.

6. The electrical connector of claim 1, wherein the front housing includes a front wall extending between a front surface and a rear surface, the front wall having a front wall thickness between the front surface and the rear surface of the front wall, and wherein the cross walls of the conductive insert have front surfaces and rear surfaces, the front surfaces engaging the rear surface of the front wall of the front housing, the cross walls having cross wall thicknesses between the front surfaces and the rear surfaces of the cross walls, the cross wall thicknesses being approximately equal to the front wall thickness.

7. The electrical connector of claim 1, wherein the front housing includes end walls and cross walls extending between the end walls, the front housing including strengthening walls parallel to the end walls, the strengthening walls of the front housing extending between the cross walls of the front housing, the end walls being aligned with corresponding end walls of the conductive insert, the cross walls being aligned with corresponding cross walls of the conductive insert, the front housing including ground contact openings being defined by the end walls, the cross walls, and the sidewalls.

8. The electrical connector of claim 7, wherein the conductive insert includes strengthening walls extending from the cross walls of the conductive insert, the strengthening walls of the conductive insert being aligned with the strengthening walls of the front housing.

9. The electrical connector of claim 1, wherein each channel receives multiple ground shields.

10. An electrical connector for mating with a mating connector having mating signal contacts and mating ground shields providing electrical shielding for the mating signal contacts, the electrical connector comprising:

a front housing having a front and a rear, the front housing having a cavity at the rear, the front configured to be mated with the mating connector; and a conductive insert received in the cavity, the conductive insert including end walls and cross walls extending between the end walls, the conductive insert includes channels between the cross walls, the channels configured to receive corresponding mating ground shields, the cross walls including protrusions extending into the channels, each protrusion having a mating interface configured to engage the corresponding mating ground shield, wherein the conductive insert is configured to electrically couple each of the mating ground shields of the mating connector.

11. The electrical connector of claim 10, wherein the cross walls extend between front surfaces and rear surfaces, the protrusions being positioned proximate to the front surfaces.

12. The electrical connector of claim 10, wherein the cross walls include the first surfaces and second surfaces facing in opposite directions and facing the channels, the first surfaces including corresponding protrusions, the second surfaces including corresponding protrusions.

13. The electrical connector of claim 10, wherein each protrusion includes a flat inner surface and a ramp extending between the corresponding cross wall and the inner surface.

14. The electrical connector of claim 10, wherein the conductive insert includes strengthening walls extending from the cross walls.

15. The electrical connector of claim 14, wherein the conductive insert includes gaps between the strengthening walls on opposing cross walls, the front housing including strengthening walls received in the gaps between corresponding strengthening walls of the conductive insert.

16. The electrical connector of claim 10, wherein the front housing includes a front wall extending between a front surface and a rear surface, the front wall having a front wall thickness between the front surface and the rear surface of the front wall, and wherein the cross walls of the conductive insert have front surfaces and rear surfaces, the front surfaces engaging the rear surface of the front wall of the front housing, the cross walls having cross wall thicknesses between the front surfaces and the rear surfaces of the cross walls, the cross wall thicknesses being approximately equal to the front wall thickness.

17. The electrical connector of claim 10, wherein the front housing includes end walls and cross walls extending between the end walls, the front housing including strengthening walls parallel to the end walls, the strengthening walls of the front housing extending between the cross walls of the front housing, the end walls being aligned with corresponding end walls of the conductive insert, the cross walls being aligned with corresponding cross walls of the conductive insert, the front housing including ground contact openings receiving corresponding mating ground shields and being defined by the end walls, the cross walls, and the sidewalls.

18. The electrical connector of claim 17, wherein the protrusions are axially aligned with the ground contact openings to interfere with the mating ground shields when mated with the mating connector.

19. The electrical connector of claim 10, wherein the protrusions are configured to engage center walls of the corresponding mating ground shields.

20. The electrical connector of claim 10, wherein the protrusions are configured to engage end walls of the corresponding mating ground shields.

* * * * *